US010940503B2

(12) United States Patent
Pastorutti

(10) Patent No.: US 10,940,503 B2
(45) Date of Patent: Mar. 9, 2021

(54) PLANT AND METHOD FOR MAKING DECORATIONS ON PREFABRICATED WATERPROOFING BITUMEN-MIX MEMBRANES

(71) Applicant: BOATO INTERNATIONAL S.P.A. A SOCIO UNICO, Monfalcone (IT)

(72) Inventor: Gino Pastorutti, Palmanova (IT)

(73) Assignee: BOATO INTERNATIONAL S.P.A. A SOCIO UNICO, Monfalcone (IT)

( * ) Notice: Subject to any disclaimer, the term of this patent is extended or adjusted under 35 U.S.C. 154(b) by 58 days.

(21) Appl. No.: 15/737,454

(22) PCT Filed: Jun. 16, 2016

(86) PCT No.: PCT/IB2016/053584
§ 371 (c)(1),
(2) Date: Dec. 18, 2017

(87) PCT Pub. No.: WO2016/203425
PCT Pub. Date: Dec. 22, 2016

(65) Prior Publication Data

US 2018/0185871 A1 Jul. 5, 2018

(30) Foreign Application Priority Data

Jun. 18, 2015 (IT) ..... 102015000025294

(51) Int. Cl.
*B05C 1/08* (2006.01)
*B05C 19/00* (2006.01)
(Continued)

(52) U.S. Cl.
CPC ..... *B05C 1/0891* (2013.01); *B05C 1/0826* (2013.01); *B05C 9/06* (2013.01);
(Continued)

(58) Field of Classification Search
USPC ..... 118/211, 212, 224, 308
See application file for complete search history.

(56) References Cited

U.S. PATENT DOCUMENTS 2,286,145 A * 6/1942 Logan, Jr. ..... E04D 5/12 427/188
3,704,164 A * 11/1972 Travis ..... B05D 5/12 428/203

(Continued)

FOREIGN PATENT DOCUMENTS

EP 0638695 2/1995
WO 2015/125089 8/2015

OTHER PUBLICATIONS

International Search Report and Written Opinion, issued in the corresponding International application No. PCT/IB2016/053584, dated Sep. 12, 2016, 8 pages.

*Primary Examiner* — Yewebdar T Tadesse
(74) *Attorney, Agent, or Firm* — Hamre, Schumann, Mueller & Larson, P.C.

(57) ABSTRACT

Plant for making decorations on a bituminous membrane including a feed device configured to feed the bituminous membrane at a determinate speed in a direction, and at least two depositing apparatuses disposed one in series with the other in the direction and configured to deposit solid particles on the bituminous membrane according to respective patterns in order to obtain respective decorations on the bituminous membrane. The depositing apparatuses each includes a transfer member configured to receive, support and transfer the solid particles from a respective feed device, to the surface to be enhanced of the bituminous membrane.

7 Claims, 3 Drawing Sheets

(51) Int. Cl.
*E04D 5/12* (2006.01)
*B05C 19/04* (2006.01)
*B05C 9/06* (2006.01)

(52) U.S. Cl.
CPC ..... *B05C 19/00* (2013.01); *B05C 19/04* (2013.01); *E04D 5/12* (2013.01)

(56) References Cited

U.S. PATENT DOCUMENTS

| | | | | | |
|---|---|---|---|---|---|
| 4,064,288 | A * | 12/1977 | Shah | H01M 6/48 | 427/58 |
| 5,795,389 | A * | 8/1998 | Koschitzky | B05C 19/06 | 118/308 |
| 5,814,369 | A | 9/1998 | Bockh et al. | | |
| 2002/0160108 | A1 | 10/2002 | Aschenbeck | | |
| 2012/0183684 | A1 | 7/2012 | Aschenbeck | | |
| 2016/0332191 | A1 * | 11/2016 | Pastorutti | E04D 5/02 | |

* cited by examiner 10
11
12
13
14
15
16
17
18
19
20
21
22
23
26
27
28
30
32
33
34
35
38
39
A
B
C
D1
D2
D3
F
H1
H2
H3
L1
L2
M
P1
P2
P3
Z

PLANT AND METHOD FOR MAKING DECORATIONS ON PREFABRICATED WATERPROOFING BITUMEN-MIX MEMBRANES

FIELD OF THE INVENTION

The present invention concerns a plant and method for making decorations, patterns or designs on a prefabricated bitumen-mix membrane, which can be used for example for covering roofs or the external surfaces of buildings, such as terraces, apartment blocks, industrial plants, but not only.

Here and hereafter in the description and claims, the term prefabricated waterproofing bitumen-mix membrane will be referred to simply as bitumen membrane.

BACKGROUND OF THE INVENTION

Bituminous membranes are known, used for waterproofing external surfaces of buildings such as roofs, terraces of apartment blocks, industrial warehouses, private residences and others.

Bituminous membranes usually consist of a base support, or core, drowned in a bitumen material such as oxidized bitumen, distilled bitumen or modified bitumen.

Plants are also known for making decorations on the bituminous membrane which provide to deposit a coating on it, with mineral-based solid particles such as slate, basalt, ferrite or suchlike, in the form of scales, granules, sand or grains.

Examples of these known plants are described in documents US-A-2012/0183684, U.S. Pat. No. 5,814,369 and US-A-202/0160108.

The solid particles not only have a decorative function, but also that of protecting the surface of the bituminous membrane exposed to atmospheric agents, for example rain, snow, ice or solar radiation.

Known plants usually comprise a depositing apparatus, configured to deposit the solid particles on the bituminous membrane and to define the desired decorations.

The depositing apparatus includes at least a containing hopper to contain the solid particles and a transfer member configured to transfer the solid particles in a metered manner from the hopper to the membrane to be coated.

The transfer member, for example a rotating drum or a belt wound between two cylinders and selectively translatable between them, is provided on its surface, external during use, with a plurality of cavities reproducing a desired decoration to be reproduced on the bituminous membrane.

Each cavity can have shape and sizes substantially analogous to those of one of the decorations to be reproduced on the surface of the membrane to be coated, for example as shown in EP-A-0638695.

In an alternative solution, for example described in the international application PCT/IB2015/051242 in the name of the present Applicant, the reception surface of the solid particles of the transfer member has one or more zones with shape and sizes substantially the same as the decorations to be reproduced, and in which there is a plurality of cavities suitable to accommodate the solid particles to be transferred to the bituminous membrane.

The cavities are filled on each occasion with the solid particles in the hopper.

Activating the transfer member causes the transfer and release onto the prefabricated membrane of the solid particles, to make the desired decorations on the membrane.

Known decoration plants generally comprise two depositing apparatuses disposed in sequence to each other.

If the deposit plant is equipped with two depositing apparatuses, one of them is configured to deposit solid particles according to a desired deposit pattern/disposition, while the other depositing apparatus, disposed downstream, distributes other solid particles uniformly over the whole surface.

Subsequently, the excess solid particles present on the membrane are removed, leaving in place only the solid particles that have adhered to the surface of the bituminous membrane.

This solution provides to coordinate only the speed of advance of the bituminous membrane with the actuation speed of the first of the depositing apparatuses, to guarantee the desired decorations are obtained on the bituminous membrane.

This coordination of the actuation speeds can be regulated directly in the field, by carrying out direct trials on the plant.

The decoration plant described above allows to make decorations on the bituminous membrane with simple and regular shapes, limiting the range of decorations obtainable on the bituminous membranes.

Furthermore, known decoration plants provide to make decorations with an orientation mainly in a direction substantially parallel to the oblong development of the bituminous membrane itself. This condition also limits the subsequent installation of the bituminous membrane.

The main orientation of the decorations, as understood here, is evaluated according to the joining line between the part that faces upward during use, and the part that faces downward during use, of the decoration.

For example, in an application of the bituminous membrane on a pitched roof, because of the orientation of the decorations the bituminous membrane must be installed parallel to the inclined side of the pitch of the roof. This condition means that the overlappings of adjacent bituminous membranes are disposed parallel to the inclined side of the pitch of the roof, with the possibility of causing leakages of water in the join zones.

One purpose of the present invention is to obtain a plant for making decorations on a bituminous membrane that allows to obtain decorations with desired shapes, not geometrically limited and also particularly complex.

Another purpose of the present invention is to obtain a plant for making decorations that allows to enhance the bituminous membranes, also obtaining shaded effects between the decorations deposited.

Another purpose of the present invention is to perfect a method for obtaining bituminous membranes that do not limit the subsequent installation of the bituminous membrane.

Another purpose of the present invention is to perfect a method for making membranes that allows to obtain on the latter decorations disposed with their main orientation transverse to the lengthwise development of the bituminous membrane itself.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a plant for making decorations on a bituminous membrane comprises feed means configured to feed the bituminous membrane at a determinate speed in a predefined direction, and at least two depositing apparatuses disposed one in series with the other in said direction and configured to deposit solid particles on the bituminous membrane according to respective patterns in order to obtain respective decorations on the bituminous membrane. The depositing apparatuses each comprise a transfer member configured to receive, support and transfer the solid particles from a respective feed device, to the surface to be enhanced of the bituminous membrane.

In accordance with one aspect of the present invention, the plant comprises synchronization means associated with the transfer members and configured to manage the drive speed of each of the transfer members and to control and synchronize the drive speeds of the depositing apparatuses at least according to construction or installation parameters of the depositing apparatuses.

The construction or installation parameters comprise at least one of either sizes of the transfer members, distances of the transfer members with respect to the bituminous membrane, and reciprocal positions of the transfer members.

The synchronization means allow to synchronize the apparatuses with each other so that each of these deposits the solid particles on different surface regions of the bituminous membrane, according to a predetermined pattern, so that each depositing apparatus is able to generate a predefined decoration.

In accordance with another aspect of the present invention, the plant also comprises a control and command unit connected at least to the synchronization means and to the feed means and configured to control and command the synchronization means and the feed means so as to suitably regulate the speed of movement of the bituminous membrane also as a function of the discharge speed of the solid particles by the transfer members, thus obtaining a controlled deposit and obtaining the desired decorations. In this way it is possible to coordinate the actuation speeds of the transfer members and the speed of movement of the bituminous membrane with respect to each other.

The present invention also concerns a method for making decorations on a bituminous membrane, which comprises feeding the bituminous membrane at a determinate speed in a direction using feed means, and depositing, using at least two depositing apparatuses disposed one in series with the other in said direction, solid particles according to respective patterns so as to obtain respective decorations on the bituminous membrane. In each of the depositing apparatuses the depositing comprises the reception in a transfer member of the solid particles from a respective feed device, and supporting and transferring the solid particles to the surface to be enhanced of the bituminous membrane. In accordance with one aspect of the invention, the method comprises an adjustment of the drive speed of each of the transfer members and a control and reciprocal synchronization of the drive speeds of the transfer members, using synchronization means, at least according to construction or installation parameters of the depositing apparatuses. It also provides to control and command the actuation of the feed means and the synchronization means by a control and command unit in order to manage the discharge modes of the solid particles from each of the transfer members onto the bituminous membrane as a function of the speed of movement of the latter in said direction to define said decorations.

According to a possible implementation of the depositing method, before said setting step, it provides to assign an orientation to the decorations, defining for each of them at least the part that, during use, faces upward and the part that, during use, faces downward, in relation to the installation of the bituminous membrane. Moreover, during the depositing the decorations are made so that the line joining the part that, during use, faces upward and the part that, during use, faces downward of the decorations is transverse to the direction of feed of the bituminous membrane, that is, to the longitudinal development of the latter.

In this way, the bituminous membrane can be installed, for example, on a pitched roof, transverse to the sloping side of the pitch of the roof, that is, with its longitudinal development parallel to the length of the pitch of the roof.

This allows to install the bituminous membranes partly overlapping each other, putting the overlapping areas substantially parallel to the length of the pitch of the roof. This installation condition allows to prevent infiltrations between the joint areas between the bituminous membranes, since the membrane located highest during use will be placed partially overlapping the bituminous membrane located lowest during use.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figures 1, 2:
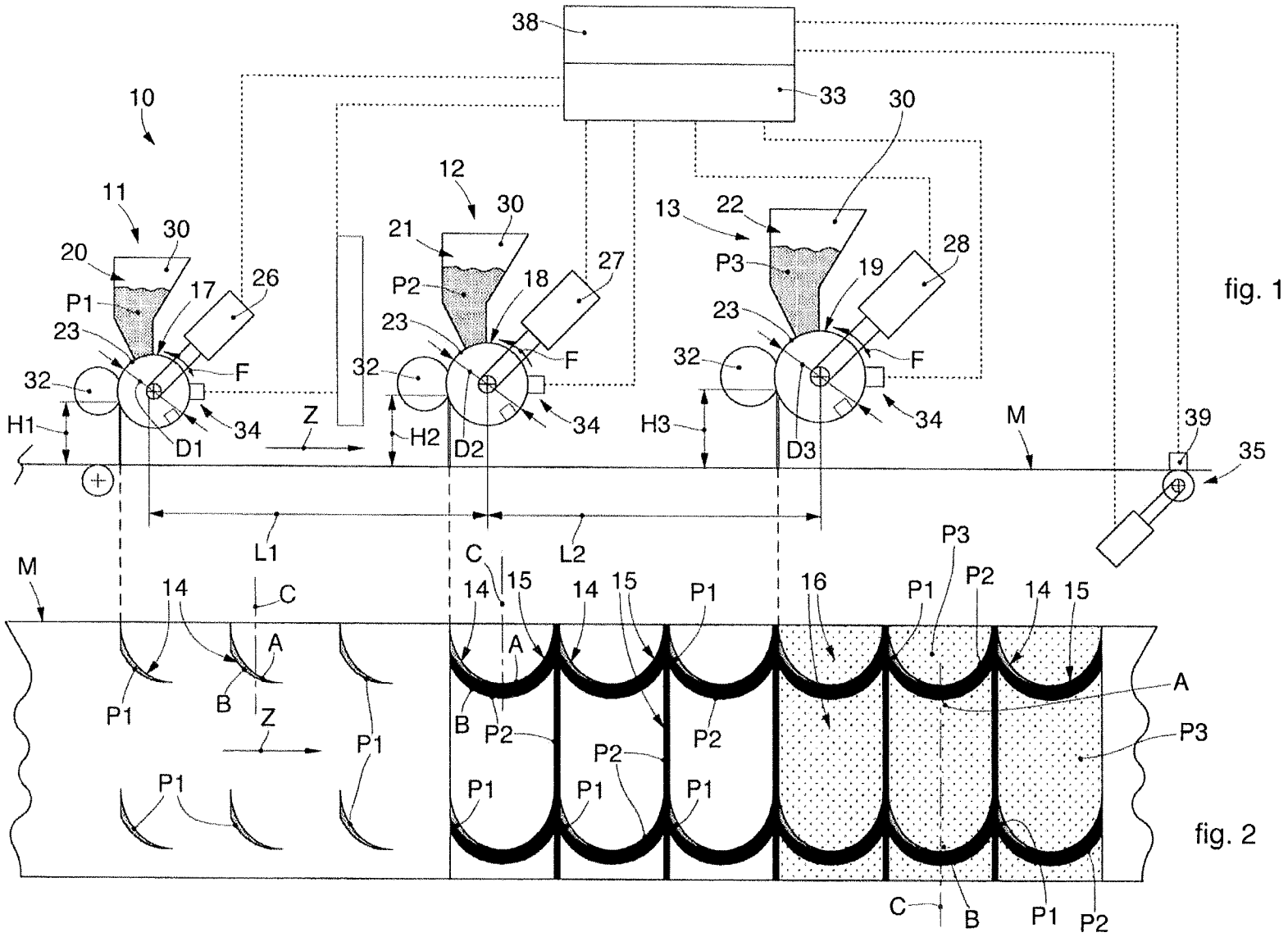
FIG. 1 is a schematic view of a plant for making decorations on bituminous membranes.
FIG. 2 shows a possible bituminous membrane during the creation of the decorations.

According to the present invention, a plant 10 for making decorations on one or more bituminous membranes M comprises at least two depositing apparatuses, in this case three, respectively a first depositing apparatus 11, a second depositing apparatus 12 and a third depositing apparatus 13.

The first depositing apparatus 11, the second depositing apparatus 12 and the third depositing apparatus 13 are disposed one in series with the other in a direction Z, corresponding with the direction of feed of the bituminous membrane M.

Each of the first depositing apparatus 11, the second depositing apparatus 12 and the third depositing apparatus 13 is configured to deposit on the bituminous membrane M solid particles P1, P2, P3 in respective patterns/dispositions to obtain, on the bituminous membrane M, respectively first decorations 14, second decorations 15 and third decorations 16.

The bituminous membrane M usually includes a support, also known as core, to which, during a step of the production cycle, a bitumen material is associated, suitable to allow the solid particles P1, P2, P3 to adhere.

The support can be in the form of strip or gauze, with the function of reinforcing the bituminous membrane M.

The support can be made of a material in the form of fibers, such as glass fibers, aramid fibers, or polyester based fibers.

In some embodiments, the bitumen material can be chosen from the group comprising oxidized bitumen, distilled bitumen, modified bitumen.

The solid particles P1, P2, P3 are usually in the form of scales, granules, sand or grains, and are made of a mineral-based material, such as slate, basalt, ferrite or suchlike.

The solid particles P1, P2, P3 function as a coating for the bituminous membrane M and the particular disposition and distribution of the solid particles P1, P2, P3 on the surface allows to enhance the surface of the bituminous membrane M.

The solid particles P1, P2, P3 are made to adhere on the bituminous membrane M when the bitumen material is in a liquid/viscous condition. This operation can take place directly downstream of the operation to incorporate the bitumen material into the support, or following a heating of the bituminous membrane M to take the solid bitumen material to a liquid viscous state.

Following the cooling of the bitumen material the solid particles remain adherent to the bituminous membrane M.

According to the present invention, the first depositing apparatus 11, the second depositing apparatus 12 and the third depositing apparatus 13 each comprise at least one transfer member, respectively a first transfer member 17, a second transfer member 18 and a third transfer member 19, configured to receive, support and transfer the solid particles P1, P2, P3 from a respective feed device, that is, from a first feed device 20, a second feed device 21 and a third feed device 22, to the surface of the bituminous membrane M to be enhanced.

In particular, the first feed device 20, second feed device 21 and third feed device 22 are configured to feed respectively first solid particles P1, second solid particles P2 and third solid particles P3 having different properties from each other, for example different color, different grain size or different material.

The first transfer member 17, second transfer member 18 and third transfer member 19 are configured to deposit in a metered manner the solid particles P1, P2 and P3 and to define on the surface of the bituminous membrane M to be enhanced respectively the first decorations 14, the second decorations 15 and the third decorations 16.

According to some possible solutions of the invention, the first transfer member 17, second transfer member 18 and third transfer member 19 are each connected to a respective actuation member, in the case shown in FIG. 1 a first actuation member 26, a second actuation member 27 and a third actuation member 28.

According to a possible variant embodiment, not shown in the drawings, the first transfer member 17, second transfer member 18 and third transfer member 19 can all be connected to a single actuation member as will be described hereafter.

The actuation members 26, 27 and 28 are configured to selectively take a portion of the transfer member 17, 18 and 19 from a condition in which it receives the solid particles P1, P2 and P3 from the respective feed device 20, 21 and 22 to a condition in which it delivers the solid particles P1, P2 and P3 to the bituminous membrane M.

The first transfer member 17, second transfer member 18 and third transfer member 19 are each provided with a support surface 23 on which the solid particles P1, P2 and P3 are disposed and supported before they are deposited.

Figure 3:
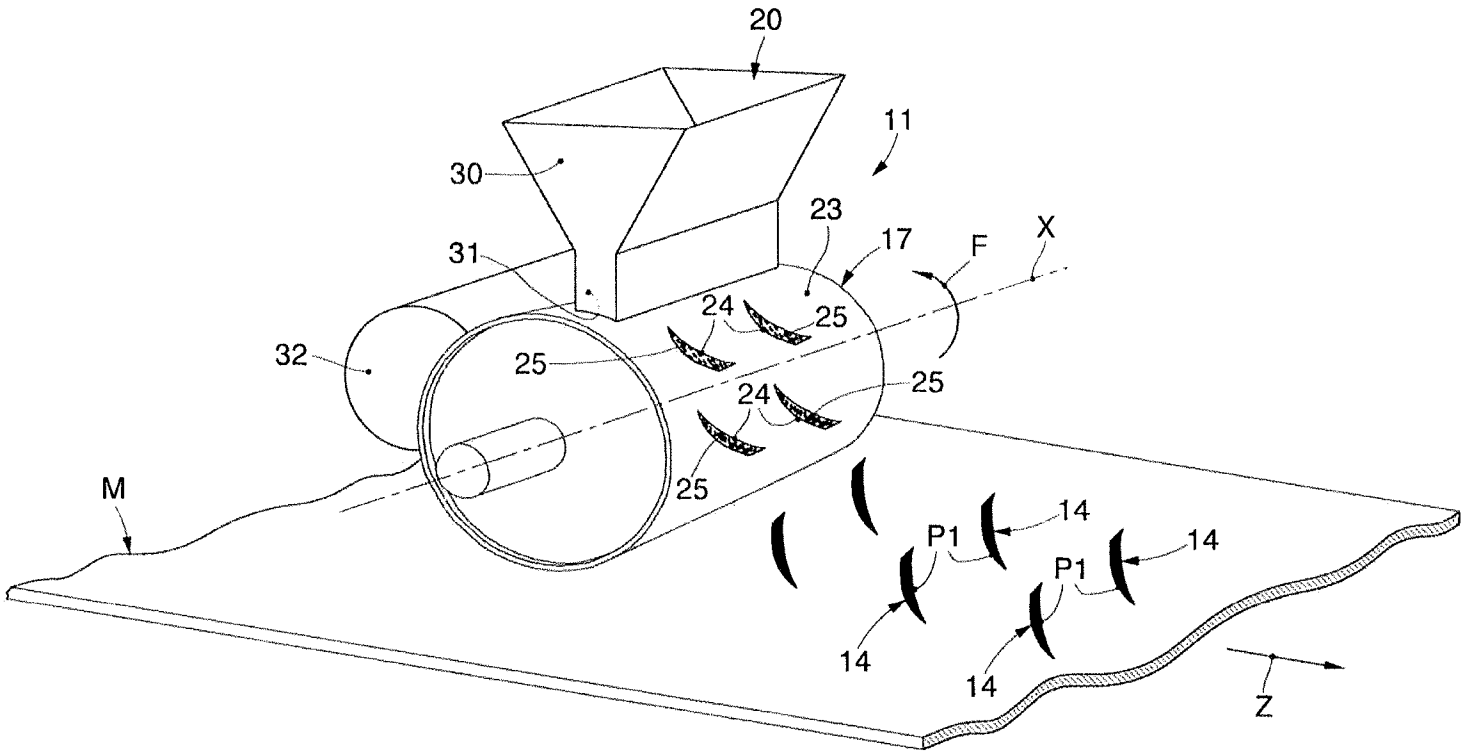
FIG. 3 shows a possible embodiment of a component of the plant according to the present invention.

According to a possible solution, for example shown in FIG. 3, the support surface 23 of each transfer member, in the case shown the support surface 23 of the first transfer member 17, is provided with a plurality of surface portions 24 in each of which a plurality of cavities 25 are made.

The surface portions 24 substantially reproduce the shape and size of at least one of the decorations 14, 15, 16 mentioned above, in this case the first decorations 14, which are to be made on the surface of the bituminous membrane M.

Each of the cavities 25 of one of the surface portions 24 of the support surface 23 of the transfer member 17, 18, 19 is suitable to contain a determinate quantity of solid particles P1, P2, P3 and to discharge them onto the bituminous membrane M in a controlled and uniform manner.

The cavities 25 are smaller in size than the surface portion 24 of the support surface 23, and allow to control the dosage of a suitable quantity of solid particles P1, P2, P3. The shape, sizes and disposition of the cavities 25 in the surface portion 24 can allow to obtain different effects on the decoration 14, 15 and 16.

On each transfer member 17, 18, 19 there can be one or more surface portions 24 containing the cavities 25, which can be repeated sequentially distanced according to a predefined pitch.

According to embodiments in FIGS. 1 and 3, the first transfer member 17, second transfer member 18 and third transfer member 19 each comprise at least a drum 29, the circumferential surface of which defines the support surface 23 on which the cavities 25 are made.

Each drum 29 can be made to rotate with the first actuation member 26, second actuation member 27 and third actuation member 28, around an axis of rotation X that can coincide with the axis of development of the drum 29.

In particular, when the cavities 25 of the drum 29 are facing upward, they receive the solid particles P1, P2 and P3 from the respective feed device 20, 21, 22 and, rotating around the axis of rotation X in the direction of rotation indicated by the arrow F in FIG. 3, discharge the solid particles P1, P2 and P3 onto the bituminous membrane M.

In embodiments described using FIG. 3, the first feed device 20, the second feed device 21 and the third feed device 22 can each comprise a hopper 30 provided with a discharge aperture 31 facing toward the support surface 23 and through which the solid particles P1, P2, P3 are discharged so that they fill the cavities 25 of the support surface 23.

According to possible embodiments, the discharge aperture 31 can be disposed in direct contact with the support surface 23, so as to limit unwanted losses of solid particles P1, P2 and P3.

According to possible solutions, the first depositing apparatus 11, the second depositing apparatus 12 and the third depositing apparatus 13, or at least one of them, can be provided with a holding device 32, disposed in contact with the support surface 23 and configured to hold the solid particles P1, P2 and P3 inside the cavities 25 of the respective transfer member 17, 18, 19 and to remove the solid particles P1, P2 and P3 that are on the support surface 23 of the transfer member 17, 18, 19 outside the cavities 25.

The holding device 32 can comprise, for example a buffer roll positioned in contact with the drum 29 on the side where the solid particles P1, P2 and P3 are deposited. The buffer roll can be made of elastically deformable material able to adapt to the shape of the support surface 23, following its development.

In other embodiments, not shown, the transfer member can comprise a belt and at least two rolls on which the belt is installed.

The belt can be closed on itself for example, and wound around the rolls.

The rolls can be provided with the actuation members suitable to make the rolls rotate, consequently moving the belt associated with them.

With its surface located outside the rolls, the belt defines the support surface 23.

The cavities 25 are made on the support surface 23 with a disposition and configuration substantially identical to what is described above.

According to one aspect of the present invention, the plant 10 is equipped with feed means 35 configured to feed the bituminous membrane M in said direction Z at a predetermined speed of movement. In particular, the feed means 35 can comprise at least one of either: unwinding and/or rewinding devices of the bituminous membrane M, support elements of the bituminous membrane M, such as support rolls, and drawing elements of the bituminous membrane M, such as drawing rolls.

According to one aspect of the present invention, the plant 10 is provided with synchronization means 33 configured to control and synchronize the drive of the first depositing apparatus 11, the second depositing apparatus 12 and the third depositing apparatus 13 at least according to construction or installation parameters of said depositing apparatuses 11, 12, 13.

In particular, the synchronization means 33 are suitable to adjust the actuation speeds of the transfer members 17, 18, 19 and to control the deposition modes of the solid particles P1, P2, P3.

The synchronization means 33 interconnect the transfer members 17, 18, 19 to adjust the actuation speed of the latter with respect to the others, thus obtaining a control of the deposition modes of the solid particles P1, P2, P3.

According to the present invention, the construction or installation parameters can comprise at least one of sizes D1, D2, D3 of the transfer members 17, 18, 19, distances H1, H2, H3 of the transfer members 17, 18, 19 with respect to the bituminous membrane M, and reciprocal positions L1, L2 of the transfer members 17, 18, 19.

For example, with reference to FIG. 1, the sizes D1, D2, D3 can be the diameters of the drums 29 of each of the transfer members 17, 18, 19 or, alternatively, in the case of transfer belts, their length. The distances H1, H2, H3 can be evaluated as the distance between the bituminous membrane M and the point where the solid particles P1, P2, P3 are discharged from the transfer member 17, 18, 19. The positions L1, L2 can be evaluated as the reciprocal distance between the first transfer member 17 and the second transfer member 18, and between the second transfer member 18 and the third transfer member 19, for example distances between the centers of the drums 29, or distances between the discharge points of the solid particles P1, P2 and P3.

By the term synchronization in the present description, we mean an action to control the actuation of the transfer members so that the discharge of the respective solid particles P1, P2, P3 is carried out by each of the transfer members in a predefined temporal sequence, suitable to allow to deposit the solid particles P1, P2 and P3 in predetermined patterns.

According to a possible solution, not shown in the drawings, the synchronization means can be the mechanical type, for example mechanical kinematisms configured to kinematically connect the transfer members 17, 18, 19.

According to possible solutions, the mechanical kinematisms can comprise at least one of either: gear mechanisms, articulated mechanisms, pulleys, toothed wheels, toothed belts, chains, speed reduction/acceleration units, or possible combinations thereof.

Merely by way of example, the mechanical synchronization means 33 can be configured to define the discharge positions of the solid particles P1, P2, P3 from the respective transfer members 17, 18, 19 depending on the pattern of the decorations to be obtained on the bituminous membrane M.

According to one embodiment, in which the synchronization means are the mechanical type, it is possible to provide that the transfer members 17, 18, 19 are all driven by a single actuation member, and that the synchronization means provide to transfer the motion from the actuation member to each of the transfer members 17, 18, 19 according to predefined drive ratios, for example by reducing and/or accelerating the actuation speed.

According to a possible solution, the synchronization means 33 can be configured to define a predefined position of the surface portions 24 of the support surface 23, between the transfer members 17, 18, 19, to guarantee the controlled and managed deposit of the decorations 14, 15, 16.

According to one aspect of the present invention, the synchronization means 33 are configured to manage the drive speed of each of the transfer members 17, 18, 19.

For example, in the case of mechanical synchronization means 33, it can be provided that they are configured to manage predefined transmission ratios between the reciprocal actuation speeds of the transfer members 17, 18, 19 and to guarantee that the solid particles P1, P2, P3 are deposited according to a prefixed pattern. As described above, the management of the drive speed can be set according to said construction and/or installation parameters.

According to a possible variant, shown for example in FIG. 1, the synchronization means 33 can be the electronic type, to control the discharge positions of the solid particles P1, P2, P3 from the respective transfer members 17, 18, 19 onto the bituminous membrane M.

According to this variant, the synchronization means 33 can be connected to the actuation members 26, 27, 28 to determine a synchronized actuation of the respective transfer members 17, 18, 19.

According to a possible solution, the synchronization means 33 can comprise position detection devices 34 associated with each of the transfer members 17, 18, 19 and configured to detect the instantaneous position of the latter, at least to evaluate the discharge positions of the solid particles P1, P2, P3 from the respective transfer member 17, 18, 19.

Depending on the information detected by the position detection devices 34, the synchronization means 33 regulate the actuation speeds of the transfer members 17, 18, 19 to define the discharge moments and positions of the solid particles P1, P2, P3.

According to a possible implementation, a reference depositing apparatus is defined among the depositing apparatuses 11, 12 and 13, in this case the first depositing apparatus 11, and the other depositing apparatuses, in the case shown here the second depositing apparatus 12 and the third depositing apparatus 13, are defined as derivative depositing apparatuses and follow the reference depositing apparatus in terms of depositing speed.

The derivative depositing apparatuses are offset in terms of space with respect to the reference depositing apparatus. The derivative depositing apparatuses therefore follow in terms of space the reference depositing apparatus with a determinate offset with respect to the zero position.

During the initialization step, by means of the position detection devices 34, it is possible to position the reference depositing apparatus in the zero position and the derivative depositing apparatuses in respective positions with predefined spatial offsets with respect to the reference depositing apparatus.

After depositing has been started, a control is periodically carried out on the position of the derivative depositing apparatuses with respect to the reference depositing apparatus, to correct any possible errors in position.

According to the embodiment shown in FIG. 1, the position detection devices 34 can comprise, for each of the depositing apparatuses 11, 12, 13, a first sensor associated with the respective transfer member 17, 18, 19 and mobile therewith, and a second fixed sensor that detects the movement of the transfer member 17, 18, 19. The first sensor can define at least a reference for setting the depositing apparatuses 11, 12, 13 which can be carried out at start-up of the plant 10.

According to one aspect of the present invention, the plant 10 comprises a control and command unit 38 connected at least to the synchronization means 33 and to the feed means 35 and configured to control and command the actuation of the synchronization means 33 and the feed means 35.

In particular, the control and command unit 38 allows to suitably manage the actuation of the synchronization means 33 to determine pre-set and predefined actuation speeds of each of the transfer members 17, 18, 19 as a function of the speed of movement of the bituminous membrane M. In this way the actuation speeds of the transfer members 17, 18, 19 are not only correlated with each other, to define a predefined pattern for depositing the solid particles, but are also correlated to the speed of movement of the bituminous membrane M.

This guarantees that the decorations 14, 15, 16 are deposited according to a pre-set and predefined pattern, that is, reproducing designs that can be particularly complex and that possibly confer shaded effects.

The control and command unit 38 is configured to manage the actuation of the feed means 35 and the synchronization means 33 according to the construction or installation parameters mentioned above.

The construction or installation parameters can be input into the control and command unit 38 during the initial setting of the plant.

According to a possible solution, the synchronization means 33 can be integrated in the control and command unit 38, which therefore manages the drive of the transfer members 17, 18, 19 and the feed means 35.

According to a possible solution, shown in FIG. 1, the control and command unit 38 can also be connected to a movement sensor 39, configured to detect the entity of movement of the bituminous membrane M along the plant 10. Based on the data detected by the movement sensor 39, the control and command unit 38 can also manage possible adjustments of the actuation speed of the transfer members 17, 18, 19 and ensure that the correct decorations 14, 15, 16 are obtained.

The control and command unit 38 can also be possibly configured to control the filling condition of the first feed device 20, second feed device 21 and third feed device 22 and to supply alarm signals if it is necessary to provide more solid particles P1, P2, P3.

The control and command unit 38 can also be configured to detect conditions of the plant that imply stoppage for various operations.

According to one implementation of the method according to the present invention, an orientation is assigned to the first decorations 14, the second decorations 15 and the third decorations 16, for example during the design phases of the plant 10.

The orientation of the first decorations 14, the second decorations 15 and the third decorations 16 is defined by establishing for each of them at least one part A that faces upward during use and another part B that faces downward during use.

The parts A that face upward during use and the parts B that face downward during use are evaluated in relation to the installation of the bituminous membrane M.

During the depositing, the first decorations 14, the second decorations 15 and the third decorations 16 are made so that the line C joining the part A that faces upward during use and the part B that faces downward during use of the decorations is located transverse to direction Z, that is, transverse to the development in length of the bituminous membrane M.

It is clear that modifications and/or additions of parts may be made to the plant and method for making decorations on prefabricated waterproofing bitumen-mix membranes as described heretofore, without departing from the field and scope of the present invention.

Another example of depositing decorations on a bituminous membrane M is shown in FIGS. 4*a*, 4*b*, 4*c*, 4*d* and 5, where four types of decorations are deposited, that is, four types of solid particles.

According to this embodiment, it is quite obvious that there are four depositing apparatuses which are managed according to the teaching identified above.

Figure 4A:
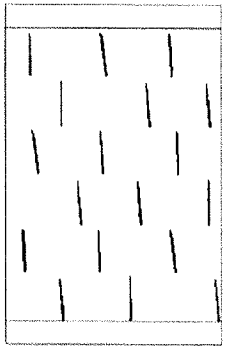
FIGS. 4*a*, 4*b*, 4*c* and 4*d* show a possible depositing sequence of solid particles on a bituminous membrane.

FIGS. 4*a*, 4*b*, 4*c* and 4*d* show with parts/zones in black the deposition patterns of the respective decorations, and in particular FIG. 4*a* shows the deposition modes of white lines (shown by vertical black segments), that is, the clearer zones of the image to be obtained.

Figure 4B:
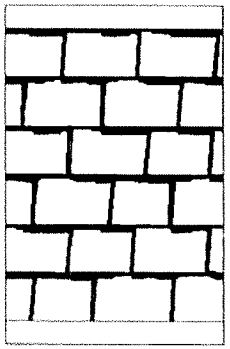
Figure 4C:
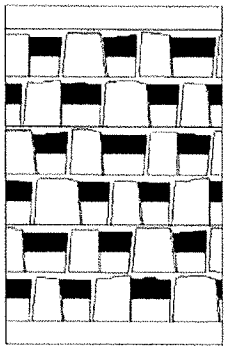
Figure 4D:
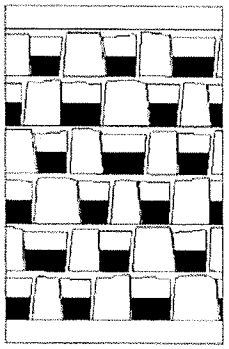
Figure 5:
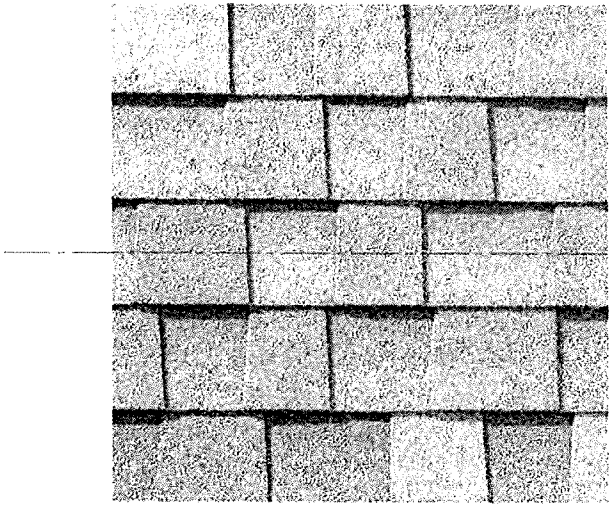
FIG. 5 shows a bituminous membrane decorated according to the depositing pattern of FIGS. 4*a*, 4*b*, 4*c* and 4*d*.

FIG. 4*b* shows the deposition mode of the dark contours of the image to be obtained. FIG. 4*c* shows the deposition modes of the darker shaded parts, while FIG. 4*d* shows the deposition modes of the filled shaded parts.

It is also clear that, although the present invention has been described with reference to some specific examples, a person of skill in the art shall certainly be able to achieve many other equivalent forms of the plant and method for making decorations on prefabricated waterproofing bitumen-mix membranes, having the characteristics as set forth in the claims and hence all coming within the field of protection defined thereby.

The invention claimed is:

1. A plant for making decorations on a bituminous membrane comprising:

feed means configured to feed said bituminous membrane at a determinate speed in a direction;

at least two depositing apparatuses disposed one in series with the other in said direction and configured to deposit solid particles on said bituminous membrane according to respective patterns in order to obtain respective decorations on said bituminous membrane, said depositing apparatuses each comprising a transfer member configured to receive, support, and then transfer said solid particles from a respective feed device to the surface to be enhanced of said bituminous membrane;

synchronization means associated with the transfer members and configured to manage the drive speed of each of the transfer members and to control and synchronize the drive speeds of said transfer members with respect to each other at least according to construction or installation parameters of said depositing apparatuses, said construction or installation parameters comprising at least one of either sizes of said transfer members, distances of said transfer members with respect to said bituminous membrane, and reciprocal positions of said transfer members; and a control and command unit connected at least to the synchronization means and to the feed means and configured to control and command said synchronization means and said feed means so as to coordinate the actuation speeds of said transfer members with respect to each other and the movement speed of said bituminous membrane.

2. The plant as in claim 1, wherein said synchronization means interconnect said transfer members to each other in order to adjust the actuation speeds of each of said transfer members with respect to the others.

3. The plant as in claim 1, wherein said synchronization means are the electronic type and are configured to control the discharge positions of the solid particles from the respective transfer members onto the bituminous membrane.

4. The plant as in claim 3, wherein said synchronization means comprise position detector devices associated to each of said transfer members and configured to detect the instantaneous position of the latter, at least to evaluate said discharge positions of the solid particles.

5. The plant as in claim 1, wherein said synchronization means are the mechanical type and are configured to kinematically connect said transfer members to each other and to define discharge positions of the solid particles from the respective transfer members.

6. The plant as in claim 1, wherein said control and command unit is connected to a movement sensor configured to detect the entity of movement of the bituminous membrane.

7. A bituminous membrane obtained by the plant of claim 1.

* * * * *